US010053632B2

(12) United States Patent
Long

(10) Patent No.: US 10,053,632 B2
(45) Date of Patent: Aug. 21, 2018

(54) USE OF SURFACTANTS IN WATER-BASED BITUMEN EXTRACTION PROCESSES

(71) Applicant: SYNCRUDE CANADA LTD. in trust for the owners of the Syncrude Project as such owners exist now and in the future, Fort McMurray (CA)

(72) Inventor: Jun Long, Edmonton (CA)

(73) Assignee: SYNCRUDE CANADA, LTD., Fort McMurray (CA), in trust for the owners of the Syncrude Project as such owners exist now and in the future ( * ) Notice: Subject to any disclaimer, the term of this patent is extended or adjusted under 35 U.S.C. 154(b) by 0 days.

(21) Appl. No.: 15/215,346

(22) Filed: Jul. 20, 2016

(65) Prior Publication Data

US 2017/0029710 A1 Feb. 2, 2017

Related U.S. Application Data

(60) Provisional application No. 62/195,408, filed on Jul. 22, 2015.

(51) Int. Cl.
*C10G 1/00* (2006.01)
*C10G 1/04* (2006.01)

(52) U.S. Cl.
CPC ..... *C10G 1/047* (2013.01); *C10G 1/045* (2013.01); *C10G 2300/208* (2013.01); *C10G 2300/805* (2013.01)

(58) Field of Classification Search
CPC .. C10G 1/047; C10G 1/045; C10G 2300/805; C10G 2300/208
See application file for complete search history.

(56) References Cited

U.S. PATENT DOCUMENTS

| | | | | |
|---|---|---|---|---|
| 3,644,194 | A * | 2/1972 | Keely | C10G 1/047 208/390 |
| 4,822,481 | A * | 4/1989 | Taylor | C10G 1/04 208/390 |
| 5,039,227 | A | 8/1991 | Leung et al. | |
| 6,007,708 | A | 12/1999 | Allcock et al. | |
| 2005/0161372 | A1 * | 7/2005 | Colic | B01D 17/047 208/391 |

(Continued)

FOREIGN PATENT DOCUMENTS

| | | | |
|---|---|---|---|
| CA | 2029795 | A1 | 11/1989 |
| CA | 2217623 | A1 | 10/1997 |
| CA | 2480122 | A1 | 1/2006 |

OTHER PUBLICATIONS

Bichard J. "Oil Sands Composition and Behaviour Research—the Research Papers of John A. Bichard 1957-1965." Apstra Technical Publication Series #4, Alberta Oil Sands Technology and Research Authority (AOSTRA). Edmonton, Alberta, 1987.

*Primary Examiner* — Randy Boyer
*Assistant Examiner* — Juan C Valencia
(74) *Attorney, Agent, or Firm* — Bennett Jones LLP

(57) ABSTRACT

A process for extracting bitumen from oil sand ore to produce a bitumen froth having reduced solids is provided, comprising mixing the oil sand ore with water and a first process aid comprising at least one surfactant to form an oil sand slurry; conditioning the oil sand slurry to produce a conditioned oil sand slurry; and introducing the conditioned oil sand slurry into a separation zone for forming the bitumen froth having reduced solids.

7 Claims, 3 Drawing Sheets

(56) References Cited

U.S. PATENT DOCUMENTS

| | | | | |
|---|---|---|---|---|
| 2005/0194292 | A1* | 9/2005 | Beetge | C10G 1/047<br>208/391 |
| 2007/0131590 | A1* | 6/2007 | Bozak | C10G 1/045<br>208/390 |

* cited by examiner

USE OF SURFACTANTS IN WATER-BASED BITUMEN EXTRACTION PROCESSES

FIELD OF THE INVENTION

The present invention relates generally to the extraction of bitumen from oil sand and, more particularly, to a process for reducing solids content in bitumen froth produced from water-based bitumen extraction processes.

BACKGROUND OF THE INVENTION

The oil sands in Northern Alberta constitute one of the largest hydrocarbon reserves in the world. Oil sands are a combination of bitumen, quartz sand, clay, water and trace minerals. Bitumen can be recovered from oil sands using two main methods: open-pit mining and in situ drilling. Approximately 20% of the oil sands lie close enough to the earth's surface to be mined.

The key characteristic of Alberta oil sand that makes bitumen economically recoverable is that the sand grains are hydrophilic and encapsulated by a water film which is then covered by bitumen. The water film prevents the bitumen to be in direct contact with the sand and, thus, by slurrying mined oil sand with heated water, the bitumen is allowed to be liberated from the sand grains and move to the aqueous phase. A primary separation vessel (PSV) is normally used for bitumen separation and bitumen froth production.

The PSV product, or primary bitumen froth, is a mixture of bitumen, water, and solids. The target composition of this froth product is ≥60 wt % in bitumen, ≤30 wt % in water, and ≤10 wt % in solids. To enable downstream upgrading, the PSV froth must first be cleaned in a froth treatment process to reduce the water and solids contents to desirable levels. However, when the quality of the PSV froth becomes poorer and, in particular, when the froth solids content becomes high (i.e., greater than 10 wt %), it will negatively impact the froth treatment process and the quality of the final product of the froth treatment process.

Several different water-based bitumen extraction processes have been developed throughout the years. One such extraction process is commonly referred to in the industry as the "hot water process". In general terms, the hot water process involves feeding the mined oil sand into a rotating tumbler where it is mixed for a prescribed retention time (generally in the range of 2 to 4 minutes) with hot water (approximately 80-90° C.), steam, caustic (e.g., sodium hydroxide) and naturally entrained air to yield a slurry that has a temperature typically around 80° C. The bitumen matrix is heated and becomes less viscous. Chunks of oil sand are ablated or disintegrated. The released sand grains and separated bitumen flecks are dispersed in the water. To some extent bitumen flecks coalesce and grow in size. They may contact air bubbles and coat them to become aerated bitumen. The term used to describe this overall process in the tumbler is "conditioning". The conditioned oil sand slurry is then subjected to gravity separation, generally in a PSV, to produce a bitumen froth product.

Another extraction process, which is disclosed in Canadian Patent No. 2,029,795 and U.S. Pat. No. 5,039,227, involves the use of a pipeline to condition oil sand slurry. In this process, heated water (typically at 95° C.) is mixed with the dry as-mined oil sand at the mine site in predetermined portions using a device known as a "cyclofeeder", to form an aerated slurry having a temperature in the range of 40-70° C., preferably about 50° C. The slurry is then pumped to the extraction plant through several kilometres of pipeline, where conditioning (i.e., lump digestion, bitumen liberation, coalescence and aeration) occurs. Once again, the conditioned oil sand slurry is then subjected to gravity separation, generally in a PSV, to produce a bitumen froth product.

In an attempt to reduce the thermal energy requirement per tonne of oil sand, a low energy extraction process for extracting bitumen from oil sand was developed, which is disclosed in Canadian Patent No. 2,217,623 and U.S. Pat. No. 6,007,708. This process involves mixing the mined oil sand with water in predetermined proportions in a mix box located near the mine site to produce a slurry containing entrained air and having a controlled density in the range of 1.4 to 1.65 g/cc and preferably a temperature in the range 20-40° C. The slurry is then pumped through a pipeline to condition the slurry. Once again, the conditioned oil sand slurry is then subjected to gravity separation, generally in a PSV, to produce a bitumen froth product.

Another bitumen extraction process uses a slurry preparation unit as described in Canadian Patent No. 2,480,122. In this process, little or no rejects will be produced during slurry preparation. The slurry preparation unit comprises a series of roll crushers spread vertically throughout a portion of a slurry preparation tower. The slurry preparation tower typically uses gravity to move the oil sand through the tower. Typically, each roll crusher is made up of a number of crusher rolls spaced a set distance apart to reduce the size of large pieces of oil sand before the pieces of oil sand drop through the crusher rolls to the next roller crusher beneath or the bottom of the slurry preparation tower. Each successively lower roll crusher reduces the pieces of oil sand even smaller until the oil sand is fine enough to form a pumpable oil sand slurry. Once again, the conditioned oil sand slurry is then subjected to gravity separation, generally in a PSV, to produce a bitumen froth product.

In the existing water-based bitumen extraction processes, generally caustic (e.g., sodium hydroxide) is used as a process aid to improve the overall performance, including froth quality. Caustic helps the release of natural surfactants and affects surface properties of bitumen, sand, and clays. The use of caustic reduces the attachment of fine solid particles on bitumen surface.

Another technology that has been employed mainly for froth quality improvement involves the use of a high temperature froth underwash in a separation vessel such as a PSV (see U.S. Pat. No. 9,051,518). Froth underwash is the gentle and uniform distribution of a water layer at the vicinity of the froth-middlings interface in a PSV. Its function is to establish a favorable environment for the froth formation step by facilitating the rising of bitumen droplets and preventing solids/fines to reach the froth-middlings interface.

Despite these advancements, froth quality remains an on-going concern with many of the aforementioned extraction operations. For example, when using the low energy extraction process, the PSV froth solids content doesn't always meet the target of ≤10 wt %, and, often, the solids content is in the range of ≥12 wt % up to as high as 16%. The hot water process generally yields better results; however, still, the average froth solids content is generally around 11.0 wt % and can be up to 14% or higher.

Thus, high froth solids content remains a problem in the industry and even though significant efforts have been made over the years, reducing froth solids content is still a challenge in the industry.

SUMMARY OF THE INVENTION

The current application is directed to a process of extracting bitumen from mined oil sand ores which uses a first process aid comprising a surfactant or a mixture of surfactants to produce a bitumen froth having reduced solids content. In one aspect, a second process aid comprising caustic (e.g., sodium hydroxide) is also used.

In accordance with one aspect of the invention, a process is provided for extracting bitumen from oil sand ore to produce a bitumen froth having reduced solids, comprising:

mixing the oil sand ore with water and a first process aid comprising at least one surfactant to form an oil sand slurry;

conditioning the oil sand slurry to produce a conditioned oil sand slurry; and introducing the conditioned oil sand slurry into a separation zone for forming the bitumen froth having reduced solids and tailings.

By "conditioning" is meant digestion of oil sand lumps, liberation of bitumen from sand-fines-bitumen matrix, coalescence of liberated bitumen flecks into larger bitumen droplets and aeration of bitumen droplets. The conditioning step can be performed either by pumping the oil sand slurry through a pipeline of sufficient length (e.g., typically greater than about 2.5 km), or by agitating the oil sand slurry in a tumbler or agitation tank for a sufficient period of time, so that liberation of bitumen from sand and subsequent aeration of bitumen both have time to occur. Preferably, conditioning time is about 2 to about 12 minutes when using a tumbler and about 10 minutes or more when using a pipeline of sufficient length.

In one embodiment, the at least one surfactant is an anionic, nonionic, or combinations thereof. In one embodiment, the at least one surfactant is an anionic surfactant. In one embodiment the anionic surfactant is selected from the group consisting of sodium dodecyl sulfate (SDS) and sodium dioctyl sulfocuccinate. In one embodiment, the dosage of surfactant ranges between about 1 to about 100 ppm (based on dry oil sand ore feed rate). Thus, with a dry oil sand feed rate of 1 kg/s, the chemical addition rate will be about 1 to about 100 g/s (corresponding to 1 to 100 ppm). In one embodiment, a second process aid is added selected from the group consisting of citrate (e.g., sodium citrate), triphosphate (e.g., sodium triphosphate), caustic (e.g., sodium hydroxide), or combinations thereof.

The present invention is particularly useful with poor processing oil sand ore, i.e., oil sand ore having lower bitumen recovery and/or poorer bitumen froth quality under normal processing conditions, for example, some of oil sand ores having a high fines (the solids fraction <44 μm) content and/or low bitumen content. In one embodiment, the present invention not only reduced the solids content in the bitumen froth, it also improved overall bitumen recovery.

DESCRIPTION OF THE PREFERRED EMBODIMENT

Figure 1:
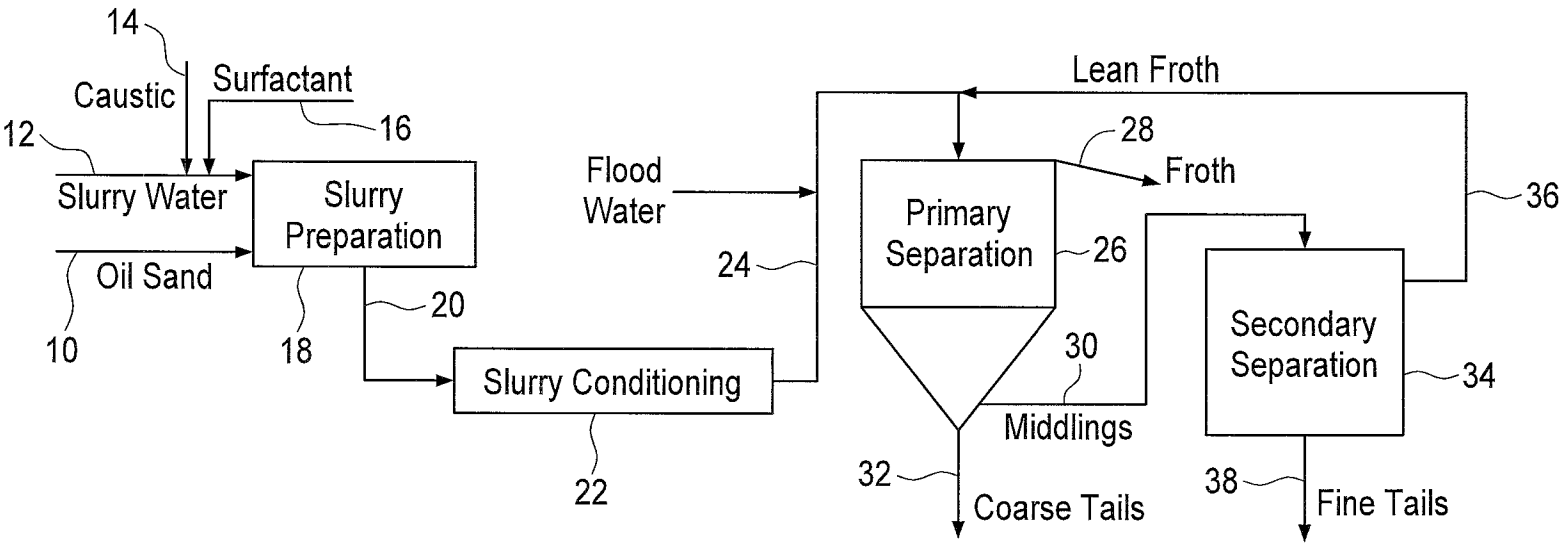
FIG. 1 is a block diagram setting forth the process in accordance with an embodiment of the invention.

The invention is exemplified by the following description and examples.

In this invention, a first process aid comprising a selected surfactant or a mixture of surfactants is used to reduce the solids content of bitumen froth. In one embodiment, a second process aid selected from the group consisting of citrate (e.g., sodium citrate), triphosphate (e.g., sodium triphosphate), caustic (e.g., sodium hydroxide), or combinations thereof is also added to a water-based bitumen extraction processes in order to reduce the solids content in bitumen froth. More particularly, a selected surfactant is generally added at the "front end" of a typical bitumen extraction process, e.g., to the slurry water, prior to the slurry preparation step. In one embodiment, caustic is also added to the process.

In one embodiment, anionic surfactants are selected for the proposed application. Examples of such anionic surfactants include sodium dodecyl sulfate (SDS) and sodium dioctyl sulfosuccinate. The dosages of surfactants used for such application should be in the range of 0 to 100 ppm (based on dry oil sand feed rate). Lab scale tests have showed that surfactant addition at higher dosages (≥200 ppm) could result in negative impact on bitumen recovery.

As used herein, "surfactant" means a surface active agent that lowers the surface tension (or interfacial tension) between two liquids or between a liquid and a solid. Surfactants may act as detergents, wetting agents, emulsifiers, foaming agents, and dispersants.

As used herein, an "anionic surfactant" means a surfactant that contains an anionic functional group at its head, such as sulfate, sulfonate, phosphate, and carboxylates. Prominent alkyl sulfates include ammonium lauryl sulfate, sodium lauryl sulfate (SDS, sodium dodecyl sulfate, another name for the compound) and the related alkyl-ether sulfates sodium laureth sulfate, also known as sodium lauryl ether sulfate (SLES), and sodium myreth sulfate. Also included is sodium dioctyl sulfosuccinate and alkylbenzene sulfonates. Anionic surfactants are dissociated in water in an amphiphilic anion, and a cation, which is in general an alkaline metal ($Na^+$, $K^+$) or a quaternary ammonium.

As used herein, a "nonionic surfactant" are surfactants which do not bear an electrical charge and are often used together with anionic surfactants. Included are the ethoxylates. Further, many long chain alcohols exhibit some surfactant properties, such as the fatty alcohols, cetyl alcohol, stearyl alcohol, and cetostearyl alcohol (consisting predominantly of cetyl and stearyl alcohols), and oleyl alcohol. Examples include polyoxyethylene glycol alkyl ethers (Brij); octaethylene glycol monododecyl ether, pentaethylene glycol monododecyl ether, polyoxypropylene glycol alkyl ethers, glucoside alkyl ethers, decyl glucoside, lauryl glucoside, octyl glucoside, polyoxyethylene glycol octylphenol ethers, polyoxyethylene glycol alkylphenol ethers, nonoxynol-9, glycerol alkyl esters, glyceryl laurate, polyoxyethylene glycol sorbitan alkyl esters, polysorbate, sorbitan alkyl esters, cocamide MEA, cocamide DEA, dodecyldimethylamine oxide, block copolymers of polyethylene glycol and polypropylene glycol, poloxamers, and polyethoxylated tallow amine (POEA).

As used herein, "caustic" means a substance that causes corrosion such as sodium hydroxide (caustic soda), potassium hydroxide (caustic potash) and calcium oxide (caustic lime).

As used herein, "citrate" is a derivative of citric acid, that is, the salts, esters, and the polyatomic anion found in solution. An example of a citrate useful in the present invention is sodium citrate.

As used herein, a "triphosphate" is a salt or ester of phosphoric acid. An example of a triphosphate useful in the present invention is sodium triphosphate (also known as sodium tripolyphosphate or tripolyphosphate).

With reference to FIG. 1, a schematic of a typical water-based bitumen extraction process is shown. Oil sand ore 10 is added to a slurry preparation unit 18 such as a cyclofeeder, tumbler, mix box and the like, as well as slurry water 12, in order to form an oil sand slurry. Added to slurry water 12, or, in the alternative, added separately to the slurry preparation unit 18, is caustic 14 (e.g., NaOH) and surfactant 16, e.g., sodium dodecyl sulfate. The oil sand ore, water, and additives are mixed to form an oil sand slurry 20. The oil sand slurry 20 is then conditioned in a slurry conditioner 22 such as a tumble or a hydrotransport pipeline, so that the oil sand lumps are digested, bitumen is released from the sand-fines-bitumen matrix, the liberated bitumen flecks coalesce into larger bitumen droplets and the bitumen droplets are aerated.

The conditioned oil sand slurry 24 is then transferred to a separation device such as a primary separation vessel 26. Optionally, the conditioned slurry is flooded (diluted) with flood water and additional air may be added to the diluted slurry prior to transferring it the primary separation vessel 26. The primary separation vessel is generally operated under quiescent conditions where an upper bitumen froth layer, a middlings layer comprising water, bitumen and solids, and a coarse tailings layer are formed. The middlings layer 30 may be removed to one or more secondary flotation cells 34 or the like for secondary flotation of the bitumen still remaining in the middlings 30. Lean froth 36 obtained from secondary separation can be recycled back to the primary separation vessel 26 for recovery as bitumen froth. Coarse tailings 32 from primary separation vessel 26 and fine tailings 38 from secondary separation are sent to a disposal site (not shown). The bitumen froth 28, which is commonly referred to as "primary froth", is collected from the top of the primary separation vessel 26 for further treatment.

EXAMPLE 1

Two oil sand samples having low bitumen content and high fines content were used in the following example. In particular, the two oil sand samples tested were a marine ore with a bitumen content of 9 wt % and a fines content of 46 wt % <44 pm (Oil Sand 1) and a marine ore having a bitumen content of 8.7 wt % and a fines content of 39 wt % <44 pm (Oil Sand 2).

Figure 2:
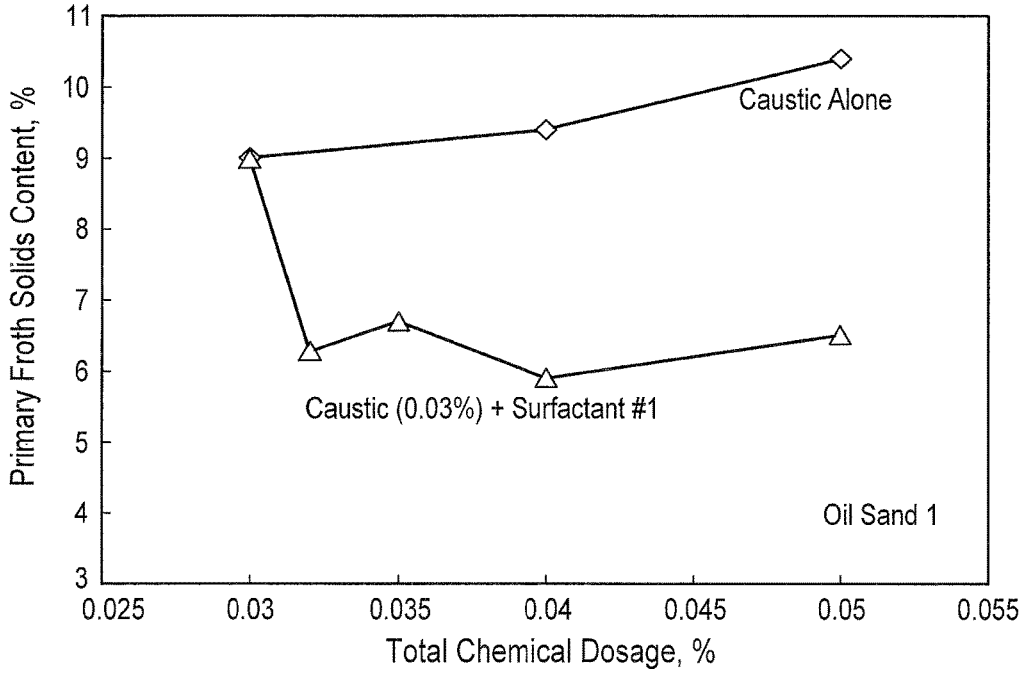
FIG. 2 is a graph showing the effect of surfactant addition on primary bitumen froth solids content (wt %) when using Oil Sand 1.

Oil Sand 1 was a very poor processing ore with the highest primary bitumen recovery being ~32 wt % with the use of caustic alone at 0.05 wt % (based on dry oil sand weight). For this oil sand ore, the use of caustic alone increased the primary froth solids content from 9.0 wt % to 10.4 wt % when caustic dosage was increased from 0.03 to 0.05 wt %. This can be seen in FIG. 2, solid diamonds. However, with the use of a selected surfactant, in this case, sodium dodecyl sulfate, at a dosage as low as 20 ppm (0.002 wt %), in addition to the use of caustic at 0.03 wt %, the primary froth solids content was reduced to around 6.3 wt %. The froth solids contents were low (under 7 wt %) with the use of the surfactant up to 200 ppm (0.02 wt %); see FIG. 2, solid triangles. However, the primary bitumen recovery was significantly decreased at the high dosage of 200 ppm, thus, too high dosages of surfactant is generally not desirable due to the loss in bitumen recovery.

Figure 3:
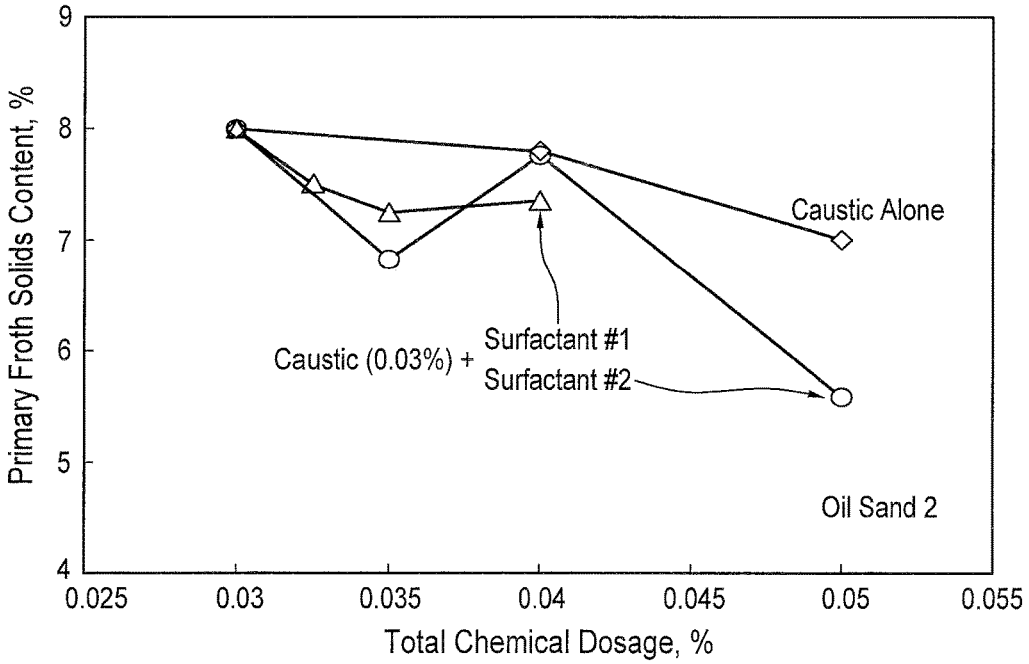
FIG. 3 is a graph showing the effect of surfactant addition on primary bitumen froth solids content (wt %) when using Oil Sand 2.

Oil Sand 2 also had a very poor processability. With the use of caustic alone, the highest primary bitumen recovery obtained was only ~27 wt % at a dosage of 0.05 wt %. For this oil sand, the primary froth solids content slightly decreased with increased addition of caustic (see FIG. 3, solid diamonds). However, the use of either surfactant #1 (sodium dodecyl sulfate) and surfactant #2 (sodium dioctyl sulfosuccinate), in addition to the use of caustic at 0.03 wt %, was able to reduce the froth solids content (see FIG. 3, solid triangles, for surfactant #1 and solid circles, for surfactant #2). Surfactant addition at low dosages (≤100 ppm or less than 0.01 wt %) also increased bitumen recovery for this oil sand. However, at higher surfactant dosages (≥200 ppm), bitumen recovery became worse that the recovery of the base cases with the use of caustic only. Solid diamonds show bitumen recovery using caustic alone.

EXAMPLE 2

Figure 4:
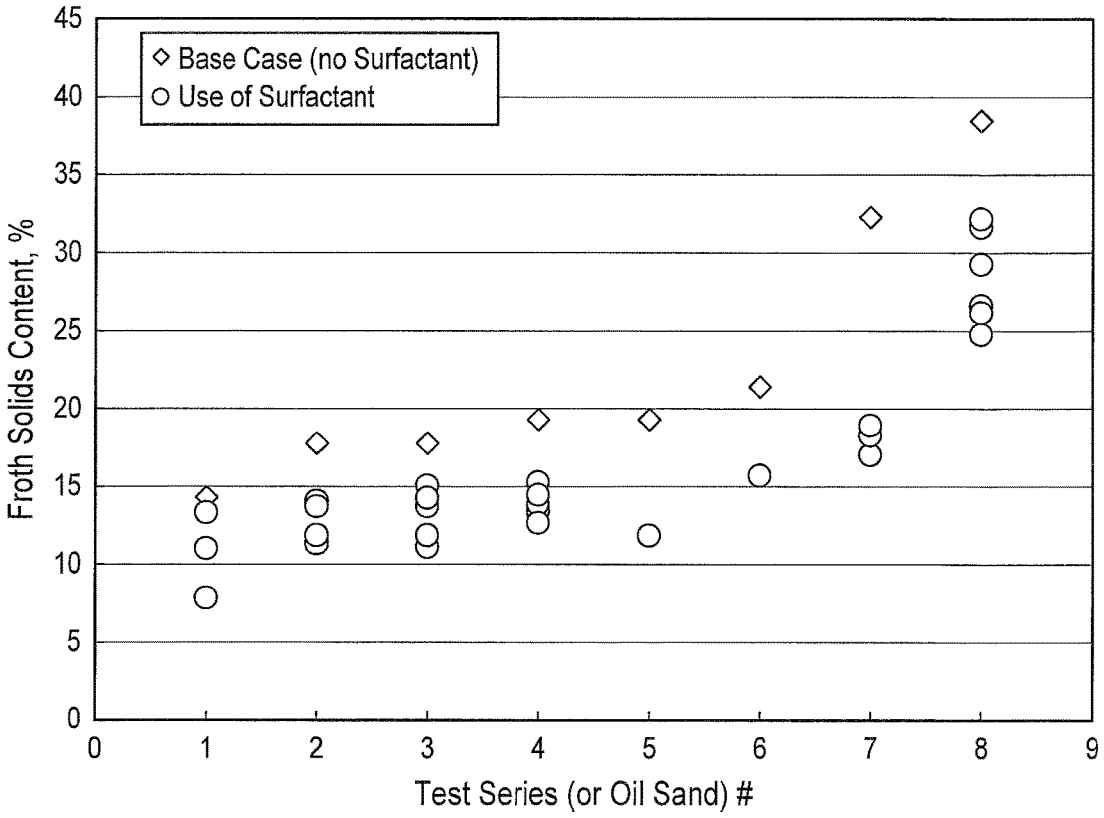
FIG. 4 is a graph showing the effect of surfactant addition on primary bitumen froth solids content (wt %) when using a variety of surfactants and a variety of oil sand ores.

Batch scale tests were done on a variety of different oil sand ore samples using a variety of surfactants and the results are shown in FIG. 4. In batch scale tests, the solids content in bitumen froth is generally much higher than that found in bitumen froth during commercial operations (i.e., a continuous process. Furthermore, a number of poor quality oil sand ores (i.e., low bitumen/high fines) were tested, which also account for the high solids contents in the batch test froth. Nevertheless, batch scale tests are useful to obtain general trends in solids reduction.

The surfactants tested in these batch scale tests include disodium ethylenediaminetetraacetate (versene), $C_{18}H_{37}NH(CH_2)SO_3Na$, sodium stearate ($C_{18}H_{35}NaO_2$), and sodium oleate ($C_{18}H_{33}NaO_2$). When comparing the results of the base cases without using surfactants (solid diamonds), to the results when selected surfactants are used (open circles), it can be seen that use of surfactant reduced the froth solids content in all instances. On average, for all data shown in FIG. 4, the use of surfactants reduced the froth solids content by ~29 wt %. Thus, from these results, it is expected that the froth solids content can be reduced to below 10 wt % during commercial operations. In particular, the use of selected surfactants in a commercial low-energy extraction process, where routinely the froth solids can be as high as ~14 wt %, may reduce the solids content in the froth to an acceptable level of ≤10 wt %.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

I claim:

1. A water-based process for extracting bitumen from mined oil sand ore to produce a bitumen froth having reduced solids, comprising:

(a) adding to the oil sand ore essentially only water, a first process aid consisting essentially of at least one anionic surfactant, and, optionally, a second process aid selected from the group consisting of citrate, triphosphate, caustic, or combinations thereof, to form an oil sand slurry;

(b) conditioning the oil sand slurry to produce a conditioned oil sand slurry; and (c) introducing the conditioned oil sand slurry into a separation zone for forming the bitumen froth having a solids content of about 10 wt % or less.

2. The process as claimed in claim 1, wherein the anionic surfactant is a surfactant that contains an anionic functional group at its head selected from the group consisting of sulfate, sulfonate, phosphate, and carboxylates.

3. The process as claimed in claim 1, wherein the anionic surfactant is selected from the group consisting of ammonium lauryl sulfate, sodium dodecyl sulfate (SDS), lauryl ether sulfate (SLES), sodium dioctyl sulfosuccinate and sodium myreth sulfate.

4. The process as claimed in claim 1, wherein the anionic surfactant is selected from the group consisting of sodium dodecyl sulfate (SDS) and sodium dioctyl sulfocuccinate.

5. The process as claimed in claim 1, wherein the dosage of the at least one anionic surfactant ranges between about 1 to about 100 ppm based on dry oil sand ore feed rate.

6. The process as claimed in claim 1, the second process aid being added, wherein the second process aid is caustic.

7. The process as claimed in claim 6, wherein the caustic is sodium hydroxide.

* * * * *